US012152855B2

(12) United States Patent
Kolmakov

(10) Patent No.: US 12,152,855 B2
(45) Date of Patent: Nov. 26, 2024

(54) DEVICE FOR QUICKLY REPLACING A MAGAZINE

(71) Applicant: Alexander Alexeevich Kolmakov, Irkutsk (RU)

(72) Inventor: Alexander Alexeevich Kolmakov, Irkutsk (RU)

( * ) Notice: Subject to any disclaimer, the term of this patent is extended or adjusted under 35 U.S.C. 154(b) by 0 days.

(21) Appl. No.: 17/904,813

(22) PCT Filed: Feb. 24, 2021

(86) PCT No.: PCT/RU2021/050045
§ 371 (c)(1),
(2) Date: Aug. 23, 2022

(87) PCT Pub. No.: WO2021/173043
PCT Pub. Date: Sep. 2, 2021

(65) Prior Publication Data

US 2023/0107470 A1 Apr. 6, 2023

(30) Foreign Application Priority Data

Feb. 24, 2020 (RU) ..... 2020107951

(51) Int. Cl.
*F41A 9/68* (2006.01)
*F41A 9/12* (2006.01)
*F41A 9/59* (2006.01)

(52) U.S. Cl.
CPC *F41A 9/68* (2013.01); *F41A 9/12* (2013.01); *F41A 9/59* (2013.01)

(58) Field of Classification Search
CPC ..... F41A 9/68; F41A 9/12; F41A 9/59
USPC ..... 42/18
See application file for complete search history.

(56) References Cited

FOREIGN PATENT DOCUMENTS

RU 2729138 C1 * 8/2020 ..... F41A 9/05

* cited by examiner

*Primary Examiner* — Samir Abdosh

(57) ABSTRACT

A device for quickly replacing the magazine of a handheld automatic small arm having a bullpup configuration relates to military equipment and is intended to maximally reduce the time for replacing a spent magazine and to increase the amount of ammunition that can be carried. Once a Magazine is spent, the bolt comes to rest on a bolt stop. In an embodiment involving a bolt stop the shooter removes the active magazine using a control key. Upon return the control key releases a pivoting tray that is held by a latch spring and the pivoting tray moves into a bottom position. The shooter takes hold of the part of a spare magazine which protrudes from the butt and moves the spare magazine into a magazine opening. The bolt stop releases the bolt, which under the effect of a bolt spring advances grips a round from the active magazine and rams it into the chamber. Firing can be continued immediately.

2 Claims, 6 Drawing Sheets

DEVICE FOR QUICKLY REPLACING A MAGAZINE

THE FIELD OF TECHNOLOGY

A device for quickly replacing a magazine (hereinafter referred to as DQRM-BP) of handheld automatic small arm having a bullpup configuration (hereinafter referred to as HASA-BP) relates to military equipment—small arms—handheld automatic small arm (hereinafter referred to as HASA)—assault rifles and submachine guns-auxiliary devices and mechanisms that facilitate and automate firing.

Section F "Mechanical engineering; lighting; heating; engines and pumps; arms and ammunition; blasting work"

F41 "Arms"

F41A "Functional features or structural elements common to small arms and artillery pieces, for example, cannons: supports or machines for small arms or artillery pieces"

F41A 9/00 "Feeding or loading ammunition; magazines; guides for cartridge extraction"

F41A 9/05 " . . . located one after the other"

DQRM-BP relates to the auxiliary devices of HASA-BP and is used to equip HASA-BP with a rectangular box-type magazine in order to increase the efficiency of its use by increasing the carriable amount of cartridges and reducing the time to replace a service magazine with a spare magazine.

PRIOR ART

The author has not found any direct analogues solution in the prior art.

The search has been carried out according to the prior art of the invention, aimed at the technical solution of the 1st task: increasing the capacity of magazines or the number of cartridges carried directly on the arms, and the 2nd task: reducing the time for replacing a magazine or using a device for organizing a continuous supply of cartridges into the barrel of HASA-BP.

The author has investigated the following technical solutions of the prior art:

1. EMR44 submachine gun, manufactured in Germany
2. Vesely V-42 submachine gun, manufactured in Great Britain
3. MR-40/1 submachine gun, manufactured in Germany
4. UD M42 submachine gun, manufactured in the USA
5. PP-2000 submachine gun (in the embodiment with a spare magazine instead of a butt), manufactured in the Russian Federation
6. Patent for an invention SU1607543 AI—An assembly of magazines
7. Patent for an invention SUI762096Al—Sectional magazine for small arms
8. Patent for an invention RU2155923Cl—High-capacity magazine
9. Patent for an invention RU2158890Cl—A magazine for small arms Patent for an invention RU2191338C2—An assault rifle, oblique locking device, a sight with a side visor (embodiments)
10. Patent for an invention RU2213313C2—Platform mechanism
11. Patent for an invention RU2254539Cl—Small arms with continuous firing mode (embodiments), functional components of small arms and a method for simultaneously reducing the recoil and sound level of small arms. Patent for an invention RU2373475C2—Configuration of self-detaching magazine of firearms
12. Patent for an invention RU2451892C2—A device for feeding of ammunition
13. Patent for an invention RU2517038CI—Automatic arms—3/embodiments/
14. Patent for an invention RU251957ICI—Automatic arms—4/embodiments
15. Patent for an invention RU2553536Cl—Automatic arms—9/embodiments/
16. Patent for an invention RU2576853C I Small arms—2
17. Patent for an invention US20100126053Al—An ammunition magazine with four stacks of ammunition
18. Patent for an invention US20130047481 AI—A magazine of ammunition, having two or more supply ports
19. Patent for an invention U.S. Pat. No. 3,140,554A—A double, tandem-positioned device for feeding a magazine
20. Patent for an invention U.S. Pat. No. 3,196,568A—A switching device for tandem magazine feed system
21. Patent for an invention U.S. Pat. No. 3,604,142A—Four-staple cartridge magazine
22. Patent for an invention U.S. Pat. No. 4,428,137A—Cartridge magazine
23. Patent for an invention U.S. Pat. No. 8,683,725B2—Barrel receiver fixing unit for a small arms magazine
24. Patent for an invention RU2519571Cl—Automatic arms—4/embodiments/
25. Patent for an invention RU2729139Cl "A device for quickly replacing a magazine"

Conclusion: The design solution proposed in the patent for an invention RU2729139Cl "A device for quickly replacing a magazine" (hereinafter referred to as DQRM) is the closest analogous solution for the DQRM-BP from the prior art.

Features of an analogous solution in DQRM-BP and in DQRM:

Both devices belong to the field of HASA;

In both devices, there are two magazines as part of the arm: a service magazine and a spare magazine;

In both devices, the service spare magazines are installed in the arms one after another along the main axis of the arm;

In both devices, the service magazine is fixed with latches;

In both devices, the spare magazine is fixed by way of spring-loaded guides entering into the grooves of the ridge with the grooves of the magazine;

In both devices, the spare magazine moves to the HASA opening by way of moving along the spring-loaded guides that have entered into the grooves of the ridge with grooves on the magazine;

In both devices (in one of the embodiments of each), the service magazine is removed from the HASA opening by pressing the device control key;

In both devices (in one of the embodiments of each), the bolt stop is kinematically connected to a device that provides automatical removal of the service magazine from the HASA opening after the cartridges are used up during firing;

In case of failure, both devices do not prevent replacement of the HASA magazine in the traditional way.

The main similarity of DQRM-BP and DQRM: both devices are designed to perform two identical tasks in HASA: accelerating the replacement of a magazine and increasing the carriable amount of ammunition.

At the same time, DQRM differs from DQRM-BP in that:

It is much simpler structurally;

It is only used for the HASA classic configuration;

The spare magazine is located under the HASA barrel in front of the HASA opening and along the HASA barrel;

The spring-loaded guides are fixed in the device housing under the HASA barrel along its longitudinal axis;

The spare magazine is fixed under the HASA barrel along its axis;

When installing the service magazine in place, the spare magazine moves to the HASA opening in the backwards direction, along the HASA barrel line and only along the spring-loaded guides, while having fixation on them by way of spring-loaded guides entering into the grooves of the ridge with grooves.

DQRM-BP differs from DQRM in that:

It has a more complex design;

It is only intended for use in HASA-BP;

The design has a pivoting tray with spring-loaded guides, located in the HASA-BP butt, into which the spare magazine is installed, together with a spring of the pivoting tray, a spring-loaded latch of the pivoting tray and a spring-loaded latch drive of the pivoting tray; The design has ridges on the magazine for moving the magazine along the grooves; The design has grooves for moving the service magazine;

The design has guide grooves for moving the spare magazine;

The device control key also serves for releasing the pivoting tray with spring-loaded guides from being held by the pivoting tray spring-loaded latch and changing it to the lower position due to the action of the pivoting tray spring;

The spring-loaded guides are installed directly in the pivoting tray with spring-loaded guides;

The spring-loaded guides are the initial part of the main line for transporting the spare magazine to the HASA-BP opening;

Guide grooves for moving the spare magazine due to their interaction with the ridges on the magazine for moving the magazine along the grooves are the second part (continuation) of the main line for transporting the spare magazine to the HASA-BP opening;

In one of the embodiments, the pivoting tray with spring-loaded guides is removed from the spring-loaded latch of the pivoting tray and switched to the lower position by the pivoting tray spring after pressing the control key, and in another embodiment—by setting the bolt to the bolt stop by acting through a kinematic connection on the pivoting tray spring-loaded latch through the spring-loaded latch drive of the pivoting tray.

The main and significant difference of the art claimed in DQRM-BP is that DQRM-BP is designed to equip HASA-BP, and DQRM is designed to equip HASA of the classic configuration.

DISCLOSURE OF THE INVENTION

The use of DQRM-BP in HASA-BP allows the user to solve the following tasks:

1. A reliable and quick replacement of the service magazine with a spare magazine in semi-automatic mode when cartridges are used up during firing;
2. Freeing the shooter from the "last bullet" syndrome;
3. Maintaining the concentration of the shooter's attention on the target of the fire impact during the replacement of the service magazine with a spare magazine;
4. Increasing the number of cartridges carried on HASA-BP;
5. Increasing the duration of continuous fire impact on the enemy as a whole.

The technical character of DQRM-BP is the use of an additional HASA-BP component which contributes to:

1. Speeding up the replacement of a used service magazine with a spare magazine;
2. Maximum reduction of the break in firing from HASA-BP;
3. A twofold increase in the amount of ammunition of HASA BP.

The composition of the prior art:

HASA-BP contains a barrel receiver with a barrel, a bolt, a bolt carrier with a return spring, a butt, a potato grip located in front of the magazine, a firing-and-trigger mechanism, a magazine key-type latch, an automatic bolt stop.

Composition and Operation of the Invention:

New in the state of the art is a DQRM-BP, the housing of which is located in the HASA-BP butt. After installing DQRM-BP in HASA-BP, there are two direct box-type magazines in it: one-a service magazine—in the HASA-BP opening, the other-a spare magazine-inside the DQRM-BP housing in a pivoting tray with spring-loaded guides.

The DQRM-BP (FIG. 1) operates as follows:

After emptying the service magazine when firing, the HASA-BP butt automatically locks back.

In one of the embodiments, the shooter presses the device control key, releasing the service magazine, which, under the action of the spring for removing the service magazine, is pushed out of the HASA-BP opening, moving along its guide grooves to move the service magazine. In another variant, DQRM-BP is activated by the bolt stop (kinematically connected to the device control key), which acts on the device control key after the service magazine is emptied when the bolt is locked back. The lever of the device control key via kinematical connection releases the empty service magazine from being held by the latch, and the spring for removing the service magazine pushes the empty service magazine out of the HASA-BP opening (FIG. 2).

Then, under the action of the device control key return spring, it returns to its original position. During the reverse stroke, the device control key by means of kinematic connection through the spring-loaded latch drive of the pivoting tray acts on the spring-loaded latch of the pivoting tray and releases the pivoting tray with spring-loaded guides from engagement with the spring-loaded latch of the pivoting tray. The pivoting tray with spring-loaded guides switches to the lower position from the upper position under the action of the pivoting tray spring. As a result, the edge of the spare magazine protrudes from the DQRM-BP housing (FIG. 3).

The shooter, by acting on the protruding part of the spare magazine with a hand, moves the magazine forward and upward in an arc (FIG. 4). The spare magazine first moves inside the DQRM-BP housing along the spring-loaded guides of the pivoting tray with spring-loaded guides, and then along the guide grooves for moving the spare magazine, and takes the place of the service magazine, where it is fixed in the HASA-BP opening with the help of the service magazine lock, while acting on the bolt stop.

The bolt stop releases the bolt which, moving forward under the action of the bolt spring, grips the upper cartridge from the newly installed service magazine and rams it to the chamber. HASA-BP has been reloaded and ready for firing, which can be continued immediately by pressing the trigger (see FIG. 5).

The shooter installs a new spare magazine in the space vacated in the pivoting tray at a convenient time (see FIG. 6). Moreover, the spare magazine, once in the pivoting tray, interacts with the spring-loaded guides under the pressure of the shooter's hand. For interacting with spring-loaded guides, the ridge with grooves on the magazine pulls apart the spring-loaded guides, and when it moves further upward, they enter the grooves of the ridge with grooves, further ensuring the retention of the newly installed spare magazine in the pivoting tray with spring-loaded guides.

Then, under the pressure of the shooter's hand on the spare magazine being newly installed, the pivoting tray with spring-loaded guides, compressing the pivoting tray spring, moves upwards, where, upon having reached the extreme upper position, it is fixed in the pivoting tray by the pivoting tray latch.

The cycle of using DQRM-BP is completed. HASA-BP returns to its initial state in readiness for firing, shown in FIG. 1.

The essential features of DQRM-BP are as follows:

1. Application of DQRM-BP for HASA-BP with direct box-type magazines;
2. Embedding the DQRM-BP housing into the HASA-BP butt, which keeps the previous dimensions of the HASA-BP unchanged, and this is important;
3. The presence in DQRM-BP of a pivoting tray with spring-loaded guides, a pivoting tray spring for switching it to the lower position from the upper position, a pivoting tray spring-loaded latch for holding it in the upper position;
4. The presence in DQRM-BP of spring-loaded guides fixed inside the pivoting tray with spring-loaded guides parallel to each other, the design of which is made so that when installing a spare magazine, it is gripped and held by the ridge with grooves;
5. The presence of a special ridge with grooves on the HASA-BP magazine, with which the spare magazine is held in the pivoting tray with spring-loaded guides by the spring-loaded guides, and also it moves along them when replacing the magazine;
6. The presence in DQRM-BP of a special spring for removing the service magazine;
7. The presence in DQRM-BP of a device control key, with which the service magazine lock and the pivoting tray latch are switched on and off, which latch is activated by pressing by the shooter's hand or, in another embodiment, by a bolt stop when triggered after emptying the service magazine. In this case, removal of the used service magazine from the arms opening takes place, as well as automatic switching of the pivoting tray to the lower position, and the shooter can immediately install a spare magazine in place of the service magazine;
8. The presence in DQRM-BP of a return spring of the device control key, which returns the device control key to its original position after pressing it by the shooter or—in another embodiment—through a kinematic connection on the side of the bolt stop, which leads to action on the pivoting tray latch during the reverse stroke of the device control key through the spring-loaded latch drive of the pivoting tray and to the release of the pivoting tray with spring-loaded guides from being held by the spring-loaded latch of the pivoting tray which, under the action of the spring of the pivoting tray, is switched from the upper position to the lower position together with the spare magazine fixed in it on the spring-loaded guides.

The technical result of using DQRM-BP on HASA-BP is characterized by the fact that:

1. The speed of replacing the magazine increases as much as possible;
2. The carriable amount of ammunition is doubled;
3. The duration of continuous fire exposure of the enemy from HASA-BP equipped with DQRM-BP increases;
4. The service magazine is forcibly removed from the HASA-BP opening only after the shooter presses on the device control key or—in another embodiment—as a result of the impact on it of the bolt stop kinematically connected to the device control key.

A BRIEF DESCRIPTION OF THE DRAWINGS

FIG. 1 depicts HASA-BP with a DQRM-BP in running order—with two magazines: a service magazine (9) and a spare magazine (15).

The drawing shows a general view of HASA-BP equipped with DQRM-BP ready for firing, which gives an idea of the proposed invention, its structure, the location of the DQRM-BP elements and components on HASA-BP and the position of the service and spare magazines in it. Here also all the components of DQRM-BP are shown:

1. A HASA-BP (1)—DQRM-BP is installed on it;
2. A device housing (2)—it is placed inside the HASA-BP (1) butt and serves for accommodating almost all the main units and components of DQRM-BP;
3. A pivoting tray with spring-loaded guides (3)—placed inside the DQRM-BP housing (2), it is designed for installing a spare magazine therein and moving it to the place of the service magazine;
4. A pivoting tray spring (4)—it provides the switching of the pivoting tray with spring-loaded guides (3) to the lower position (FIG. 3), it is triggered after the DQRM-BP control key (7) releases the pivoting tray from being held by the spring-loaded latch by acting on it through the pivoting tray spring-loaded latch drive (5);
5. A spring-loaded latch of the pivoting tray (5)—it provides retention of the pivoting tray in the upper position;
6. A drive of the pivoting tray spring-loaded latch (6)—it kinematically acts on the pivoting tray spring-loaded latch (5) and provides the release of the pivoting tray from being held by the pivoting tray spring-loaded latch (5);
7. A control key of the device (7)—it is used through being pressed by the shooter or—in another embodiment-after the bolt stop acts on the device control key (7) through a kinematic connection.

It provides: firstly, the removal of the used service magazine (9), and secondly, the switching of the pivoting tray with spring-loaded guides (3) to the lower position, where the spare magazine (15) is ready to be installed in place of the service magazine (9);

8. A return spring (8) of the device control key—it provides return of the device control key (7) to its original position after the device control key (7) is pressed by the shooter or—in another embodiment—after acting on it by means of kinematic connection on the side of the bolt stop;
9. A service magazine (9)—it is designed for supplying HASA-BP with cartridges during firing;
10. A ridge or a groove on the magazine for fixing the service magazine (10)—it serves for interacting with the service magazine lock in order to retain the service magazine (9) in the HASA-BP (1) opening;

11. A service magazine lock (11)—it holds the service magazine (9) in the HASA-BP (1) opening;
12. Ridges on the magazine for moving the magazine along the grooves (12)—they provide that a magazine moves along the grooves both when installing a spare magazine (15) in the place of the service magazine (9), and when removing the service magazine (9) from the HASA-BP (1) opening after using the service magazine (9);
13. Grooves for moving the service magazine (13)—they provide the required direction of movement and reliable removal of the service magazine (9) from the HASA-BP (1) opening;
14. A spring (14) for removing the service magazine—it provides ejection of the service magazine (9) from the HASA-BP (1) opening;
15. A spare magazine (15)—being in a pivoting tray with spring-loaded guides (3), it provides an increase in the carriable amount of ammunition and the possibility to quickly replace the service magazine (9) after it is emptied;
16. A ridge with grooves on the magazine (16) for interacting with the spring-loaded guides—it is located on the back wall of the box-type rectangular magazine and is designed for securely holding the spare magazine (15) inside the pivoting tray with spring-loaded guides (3) and for moving the spare magazine (15) along the spring-loaded guides of the pivoting tray with spring-loaded guides (3) at the initial stage of the pivoting tray's movement when replacing a magazine;
17. Guide grooves for moving the spare magazine (17)—made in the DQRM-BP housing (2), they provide the required direction of movement of the spare magazine (15) when it is installed in place of the extracted service magazine (9)—into the HASA-BP (1) opening—at the final stage of moving the spare magazine (15);
18. A bolt stop (18)—in one of the embodiments of the DQRM-BP it serves for automating the process of removing the service magazine (9) from the HASA-BP (1) opening after it is emptied and for switching the pivoting tray to the lower position by kinematic action on the device control key (7), and it also holds the bolt in the open position until a new service magazine (9) is installed.

FIG. 2 depicts the instant of removal of the service magazine (9) after the device control key (7) is pressed by the shooter or after acting on it by means of kinematic connection on the side of the bolt stop. The drawing gives a visual representation of the first stage of the process of replacing a magazine, for which DQRM-BP is intended, namely: removing the service magazine (9) after the bolt stop is triggered or after the device control key (7) is pressed with the shooter's finger.

Figure 1:
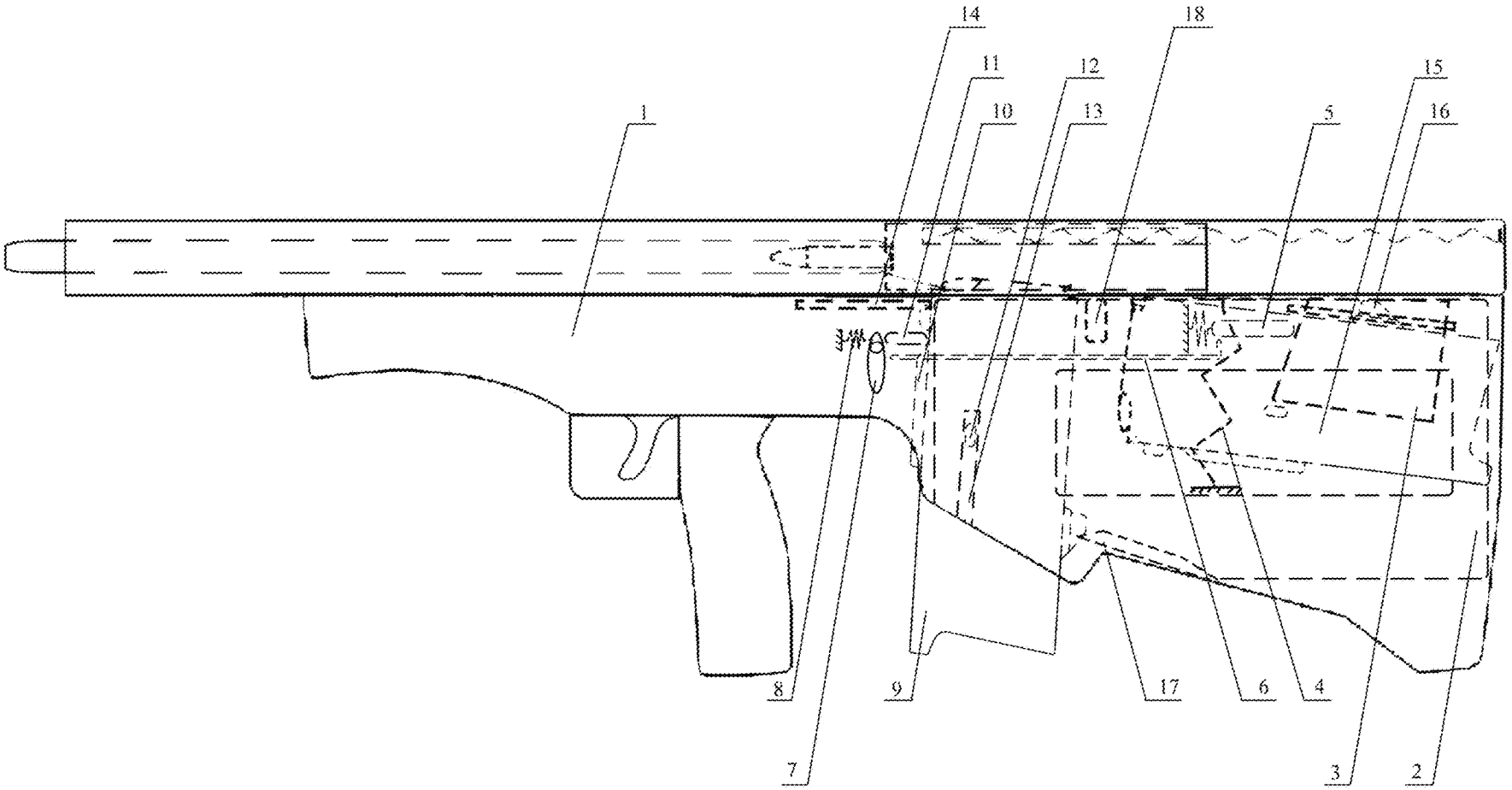
Figure 2:
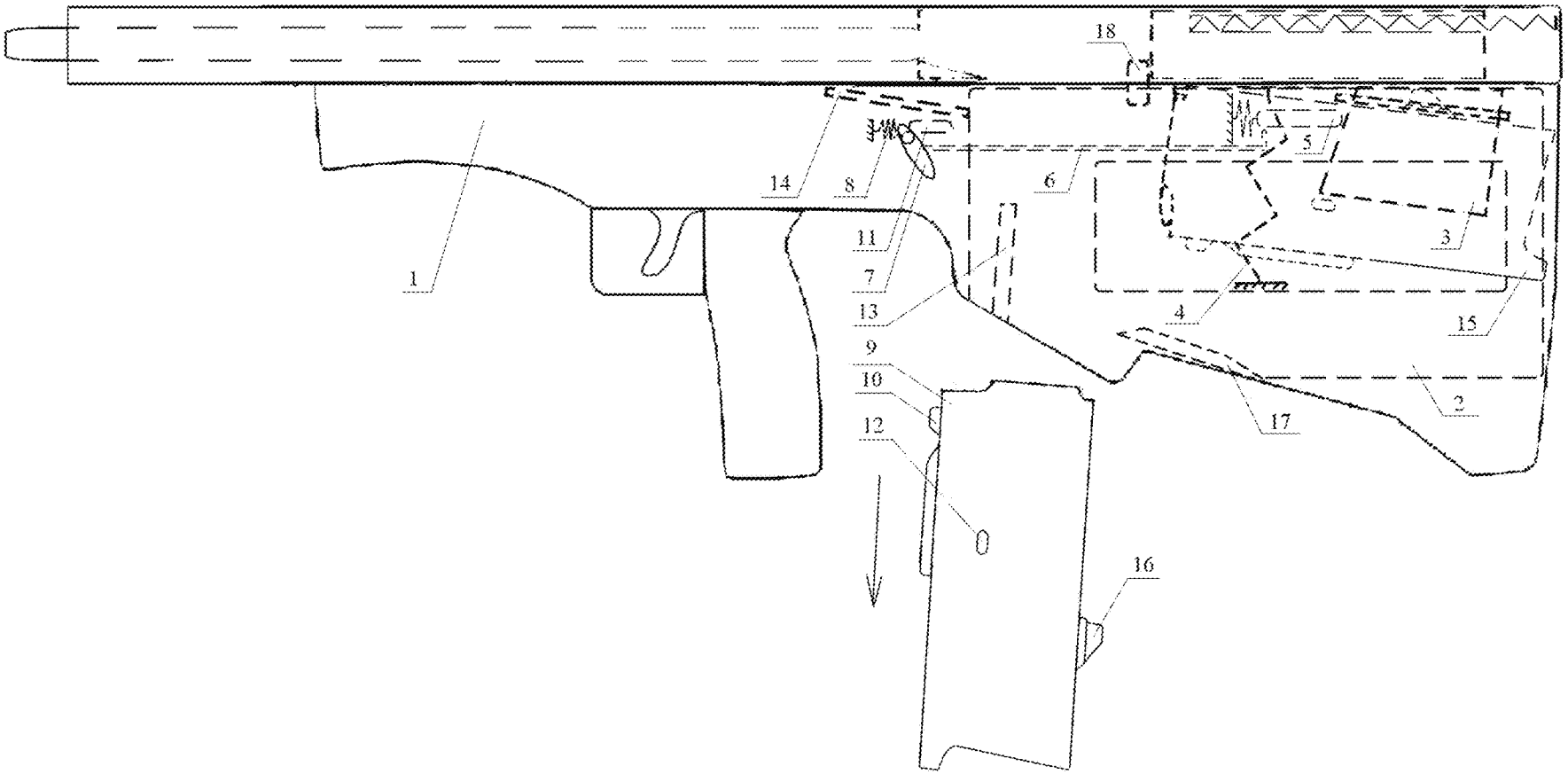
Figure 3:
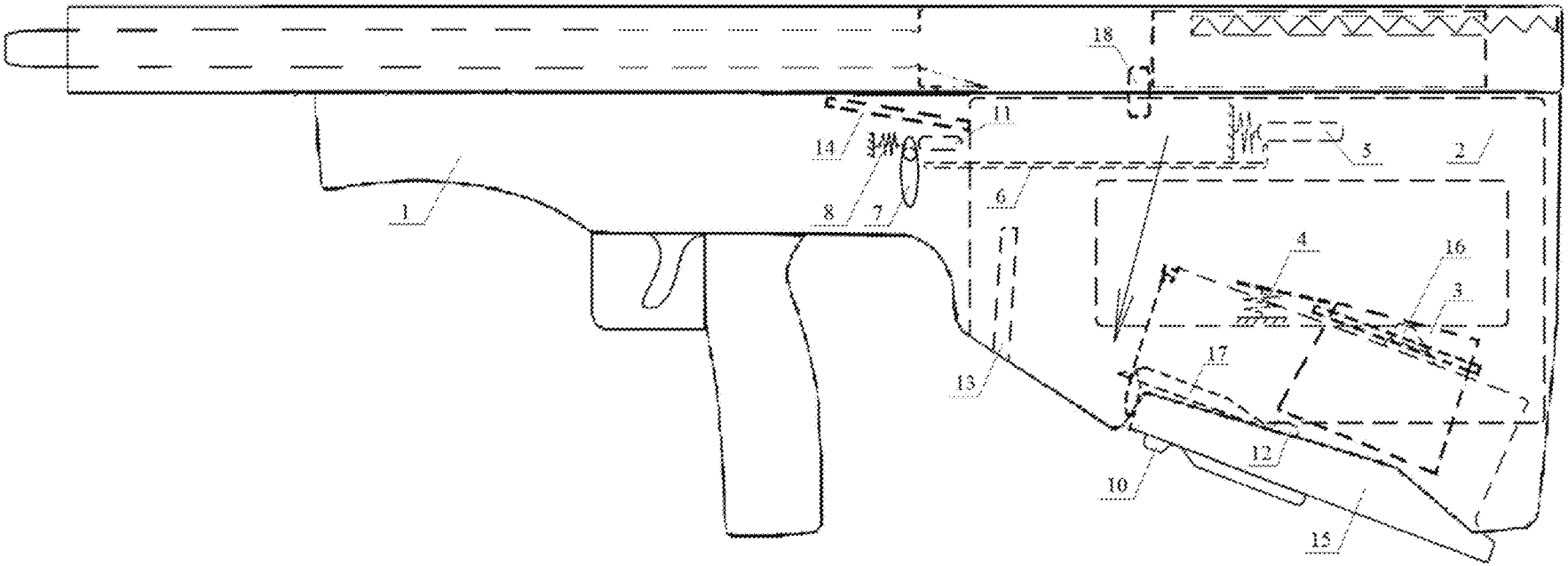
FIG. 3 depicts the following instant in the process of replacing a magazine: the switching of the pivoting tray with spring-loaded guides (3) on which the spare magazine (15) is fixed, from the upper position to the lower position. This allows the shooter to further move the spare magazine (15) into the HASA-BP (1) opening, acting with a hand on its edge protruding from the butt.
Figure 4:
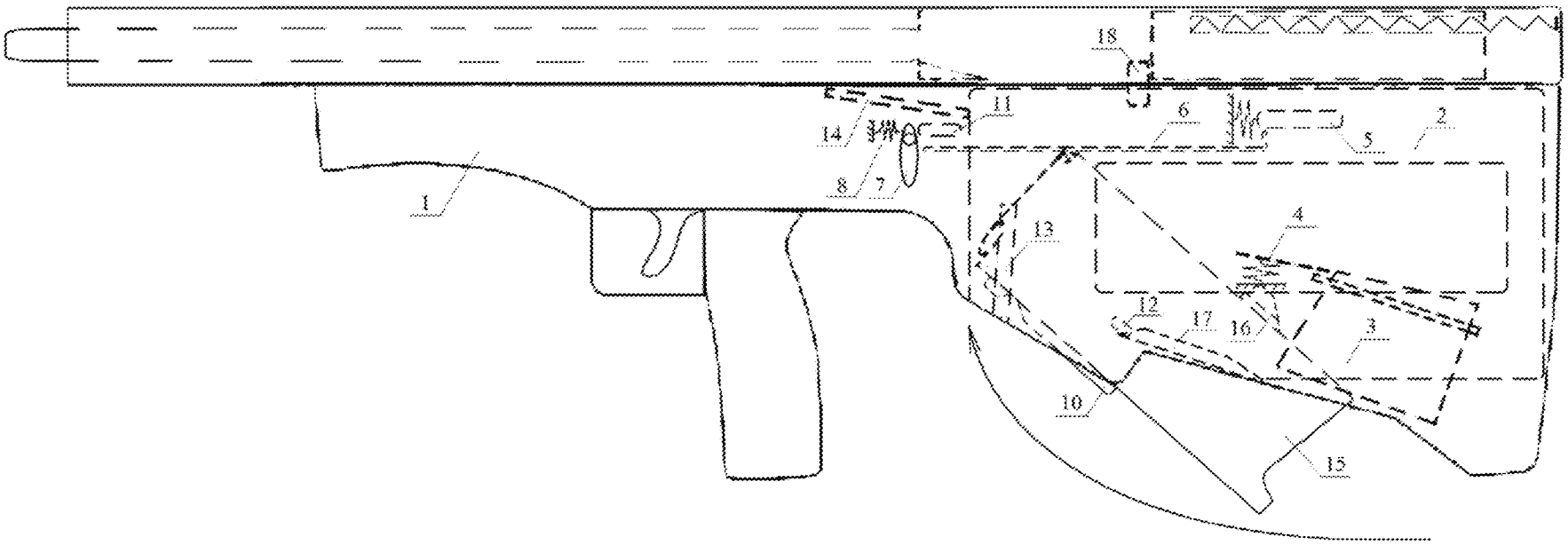
FIG. 4 depicts the process of moving the spare magazine (15) inside DQRM-BP to the place of the service magazine (9)—into the HASA-BP (1) opening. The direction of movement of the spare magazine (15) is indicated by an arrow.
Figure 5:
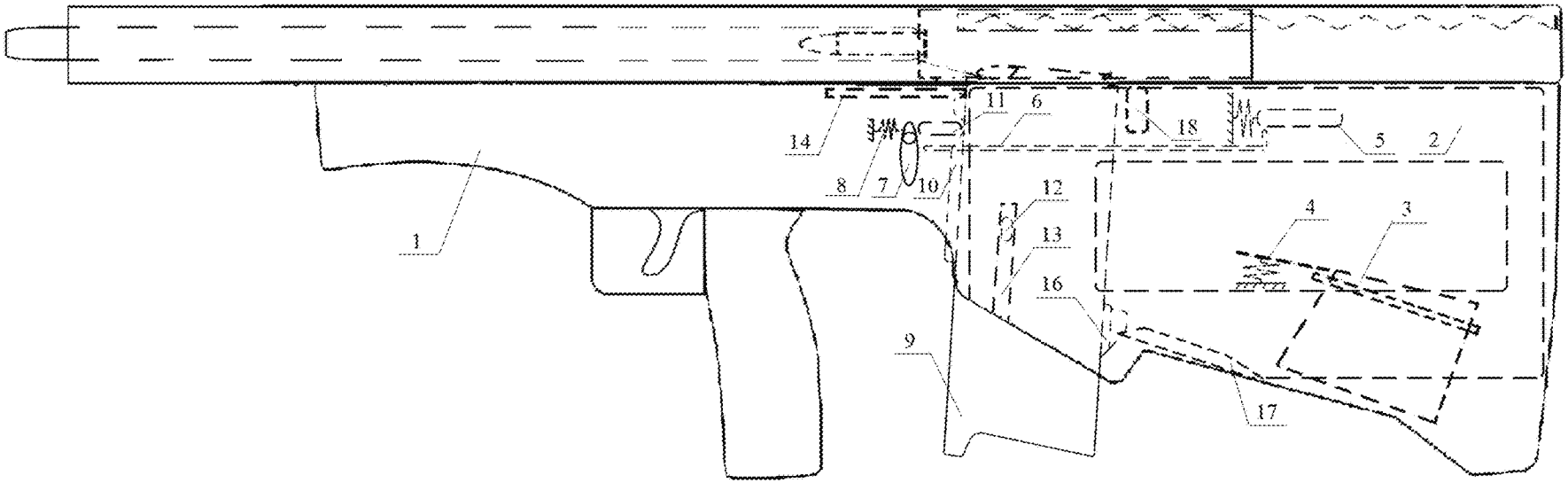

FIG. 5 depicts the instant of completion of the spare magazine (15) installation in place of the service magazine (9). The pivoting tray remains in the lower position. It's empty.

Figure 6:
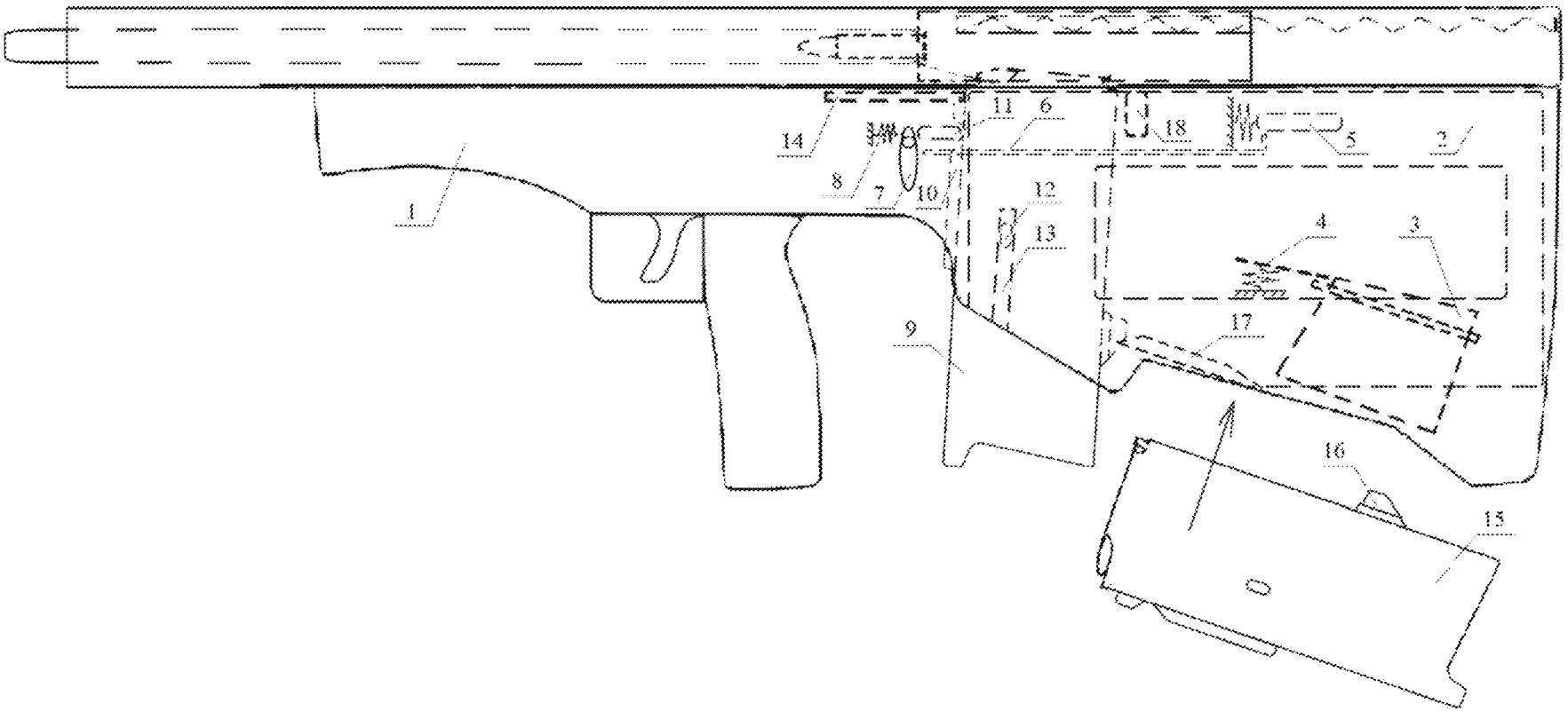

FIG. 6 depicts the final stage of using DQRM-BP. The shooter installs a new spare magazine (15) in the pivoting tray with spring-loaded guides (3) at a convenient time for himself. The direction of this action is indicated by an arrow.

Thus, the sequence of drawings in FIG. 1 to FIG. 6 displays the full cycle of the DQRM-BP operation.

THE BEST MODE FOR CARRYING OUT THE INVENTION

The best application of DQRM-BP is its use in the modernization of existing, as well as in the creation of new, improved with its help, samples of HASA-BP with direct box-type magazines.

INDUSTRIAL APPLICABILITY OF THE INVENTION

The working model of the DQRM-BP has been made by the author and confirms the operability of DQRM-BP on an advertising video posted for open access on the Internet. The video shows the implementation of all the technical tasks assigned to the inventor:

1. Installation of a spare magazine on HASA-BP;
2. Convenient, reliable, and fast replacing of a magazine.

The technical and economic efficiency of DQRM-BP consists in:

1. A significant improvement of the HASA-BP battle characteristics after installing a DQRM-BP on it due to:
1.1. Reducing the time required for replacing a magazine;
1.2. Increasing in the carriable amount of cartridges;
2. The insignificant cost of manufacturing and installing DQRM-BP on HASA-BP due to the simplicity of its design compared to the increased qualitative effect of its combat use—improvement of its battle characteristics.

The different effectiveness of the use of DQRM-BP consists in the increase in:

1. The quality and effectiveness of the use of HASA-BP due to the improvement of its battle characteristics compared to the same arms not upgraded with DQRM-BP;
2. The quality of combat use of military units armed with upgraded embodiments of HASA-BP equipped with DQRM-BP;
3. The confidence of the shooter in the capabilities of HASA-BP equipped with DQRM-BP thanks to improving the quality of its combat use-improving the battle characteristics compared to traditional HASA-BP samples due to:
3.1. The maximum reduction in the time for replacing a magazine, even if the shooter using HASA-BP equipped with DQRM-BP has no skill in quickly replacing a magazine due to bringing the magazine replacement operation to the utmost simplicity and reliability by changes in the art;
3.2. Increasing the carriable amount of ammunition;
3.3 Freeing the shooter from the "last bullet" syndrome.

The invention claimed is:

1. A device for quickly replacing a magazine of handheld automatic small arms of a bullpup configuration, for storing a spare magazine and installing it in place of a service magazine, consisting of:

housing of the device, in the butt of the arm comprising:
pivoting tray with spring-loaded guides;
spring of the pivoting tray;
spring-loaded latch of the pivoting tray;
drive of the spring-loaded latch of the pivoting tray;
a spare magazine that is coupled to the pivoting tray and adapted to hold the magazine by way of the spring-loaded guides and wherein comprising:
a plurality of guide grooves adapted for moving the spare magazine;
a ridge with grooves on the magazine configured to interact with the spring-loaded guide;
a ridge on the magazine for moving the magazine along the grooves;
a service magazine that is coupled to the housing and wherein comprising:
a plurality of grooves adapted for moving the service magazine;
a lock configured to hold the service magazine;
a spring adapted for removing the service magazine;
a ridge or groove on the magazine configured to fix the service magazine;
device control key comprising:
return spring adapted to return the device control key in the original position.

2. The device of claim 1, wherein the device control key is kinematically connected to a bolt stop for automatic extraction of the magazine when empty after.

* * * * *